US012297754B2

(12) United States Patent
Cecchi et al.

(10) Patent No.: US 12,297,754 B2
(45) Date of Patent: May 13, 2025

(54) ROCKER ARM ASSEMBLY, COMPLIANCE CAPSULES, ACTUATORS, AND SUPPORT STRUCTURES

(71) Applicant: Eaton Intelligent Power Limited, Dublin (IE)

(72) Inventors: Michele Angelo Cecchi, Turin (IT); Marco Ravoni, Rome (IT); Maria Letizia Ciardullo, Cosenza (IT); Raffaele DiMaro, Naples (IT); Nicola Andrisani, Cumiana (IT)

(73) Assignee: Eaton Intelligent Power Limited, Dublin (IE)

( * ) Notice: Subject to any disclaimer, the term of this patent is extended or adjusted under 35 U.S.C. 154(b) by 149 days.

(21) Appl. No.: 17/800,001

(22) PCT Filed: Feb. 19, 2021

(86) PCT No.: PCT/EP2021/025071

§ 371 (c)(1),
(2) Date: Aug. 16, 2022

(87) PCT Pub. No.: WO2021/164950

PCT Pub. Date: Aug. 26, 2021

(65) Prior Publication Data

US 2023/0074370 A1 Mar. 9, 2023

Related U.S. Application Data

(60) Provisional application No. 62/978,815, filed on Feb. 19, 2020.

(51) Int. Cl.
*F01L 13/00* (2006.01)
*F01L 1/18* (2006.01)
(Continued)

(52) U.S. Cl.
CPC ..... *F01L 13/0005* (2013.01); *F01L 1/182* (2013.01); *F01L 1/20* (2013.01); *F01L 1/22* (2013.01);
(Continued)

(58) Field of Classification Search
CPC ..... F01L 13/0005; F01L 13/06; F01L 1/182; F01L 1/20; F01L 1/22; F01L 1/26;
(Continued)

(56) References Cited

U.S. PATENT DOCUMENTS 4,200,081 A 4/1980 Meyer et al.
4,227,494 A 10/1980 Uitvlugt
(Continued)

FOREIGN PATENT DOCUMENTS

CN 108350771 A 7/2018
CN 109328258 A 2/2019
(Continued)

OTHER PUBLICATIONS

CN OA for Chinese Application No. 202180015170.5 mailed on Mar. 31, 2023, 10 pages.
(Continued)

*Primary Examiner* — Kenneth J Hansen
*Assistant Examiner* — Kelsey L Stanek
(74) *Attorney, Agent, or Firm* — Baker Botts L.L.P.

(57) ABSTRACT

Several devices are disclosed that can be usable together or used in other valvetrains. Disclosed herein are a rocker arm assembly, compliance capsules for a switchable capsule of the rocker arm, actuators, and support structures for the actuators. The alternative compliance capsules can be electromechanically actuated by the alternative actuators, which are hung over the rocker shaft by the support structure. A
(Continued)

cam actuator can be in addition to an overhead cam rail and in addition to the rocker shaft. The cam actuator can be configured with a compliance capsule so that the switching of the switchable capsule is mechanically linked and less reliant on precise electrical signal timing.

19 Claims, 10 Drawing Sheets

(51) Int. Cl.

| | |
|---|---|
| ***F01L 1/20*** | (2006.01) |
| ***F01L 1/22*** | (2006.01) |
| ***F01L 1/26*** | (2006.01) |
| ***F01L 1/46*** | (2006.01) |
| ***F01L 13/06*** | (2006.01) |

(52) U.S. Cl.
CPC ..... *F01L 1/26* (2013.01); *F01L 1/46* (2013.01); *F01L 13/06* (2013.01); *F01L 1/181* (2013.01); *F01L 2001/186* (2013.01); *F01L 2001/187* (2013.01); *F01L 2001/467* (2013.01); *F01L 2013/001* (2013.01)

(58) Field of Classification Search
CPC ... F01L 1/46; F01L 1/181; F01L 1/053; F01L 2001/186; F01L 2001/467; F01L 2001/187; F01L 2013/001; F01L 2305/00
USPC ..... 123/90.41
See application file for complete search history.

(56) References Cited

U.S. PATENT DOCUMENTS

| | | | |
|---|---|---|---|
| 6,273,039 | B1 | 8/2001 | Church |
| 6,354,265 | B1 | 3/2002 | Hampton et al. |
| 6,516,760 | B2 | 2/2003 | Buglioni |
| 2006/0283412 | A1 | 12/2006 | Tsuruta |
| 2011/0186008 | A1 | 8/2011 | Zapf |
| 2014/0251266 | A1 | 9/2014 | Emmons |
| 2017/0009610 | A1 | 1/2017 | Ahmed |
| 2018/0187579 | A1 | 7/2018 | Cecur |
| 2019/0063268 | A1 | 2/2019 | Buonocore et al. |
| 2019/0107011 | A1 | 4/2019 | Contarin et al. |
| 2019/0178113 | A1* | 6/2019 | McCarthy, Jr. ..... F01L 13/065 |
| 2020/0011212 | A1 | 1/2020 | Biermann et al. |
| 2020/0182108 | A1* | 6/2020 | VanWingerden ..... F02D 13/04 |
| 2020/0325803 | A1* | 10/2020 | Patil ..... F01L 1/181 |
| 2021/0317760 | A1 | 10/2021 | Cecur |
| 2021/0372299 | A1* | 12/2021 | Edke ..... F01L 1/267 |
| 2022/0145781 | A1* | 5/2022 | DiMaro ..... F01L 13/0005 |

FOREIGN PATENT DOCUMENTS

| | | | |
|---|---|---|---|
| CN | 110234849 | A | 9/2019 |
| DE | 4200510 | A1 | 7/1993 |
| EP | 0854273 | A1 | 7/1998 |
| EP | 3296531 | A1 | 3/2018 |
| GB | 2546078 | A | 7/2017 |
| IN | 201644039020 | | 5/2017 |
| JP | H10196334 | A | 7/1998 |
| JP | 2007146783 | A | 6/2007 |
| NO | 2020173607 | A1 | 9/2020 |
| WO | 2016207348 | A1 | 12/2016 |
| WO | 2018162095 | A1 | 9/2018 |
| WO | WO 2019036272 | A1 | 2/2019 |
| WO | WO 2019133658 | A1 | 7/2019 |
| WO | 2019238269 | A1 | 12/2019 |
| WO | WO 2020011400 | A1 | 1/2020 |

OTHER PUBLICATIONS

CN OA for Chinese Application No. 202180015689.3 mailed on Apr. 11, 2023, 16 pages.
International Search Report and Written Opinion for PCT/EP2021/025071; mailed Aug. 6, 2021; pp. 1-14.

* cited by examiner

ROCKER ARM ASSEMBLY, COMPLIANCE CAPSULES, ACTUATORS, AND SUPPORT STRUCTURES

PRIORITY

This application is a U.S. National Stage application under 35 U.S.C. § 371 of International Application No. PCT/EP2021/025071, filed on 19 Feb. 2021, which claims the benefit under 35 U.S.C. § 119(e) of U.S. Provisional Patent Application No. 62/978,815, filed 19 Feb. 2020.

This is an United States § 371 National Stage Application of PCT/EP2021/025071 filed Feb. 19, 2021 and claims the benefit of U.S. provisional application 62/978,815 filed Feb. 19, 2020, all of which are incorporated herein by reference.

FIELD

This application provides a rocker arm assembly. Compliance capsules for a switchable capsule of the rocker arm assembly is provided, along with actuators and support structures for the actuators.

BACKGROUND

Variable valve actuation on a valvetrain is desired. A valve can be opened, closed, or deactivated during combustion cycles for such purposes as cylinder deactivation, extended opening or closing, engine braking, among other purposes. Packaging and timing issues constrain the implementation of the variable valve actuation.

SUMMARY

Several devices are disclosed that can be usable together or used in other valvetrains. The methods and systems disclosed herein overcome the above disadvantages and improves the art by way of a rocker arm assembly, compliance capsules for a switchable capsule of the rocker arm, actuators, and support structures for the actuators.

A compliance capsule for actuating a switchable capsule in a valvetrain system can comprise a tubular member defining a cavity and comprising a first end and a second end opposite to the first end. A first body can be slidably disposed in the cavity adjacent the first end and connected to the switchable capsule to selectively transfer a motion to turn the switchable capsule on or off. A second body can be at least partially and slidably disposed in the cavity adjacent the second end and can be configured to receive a force from an external source. At least one compliance spring can be disposed between the first body and the second body.

A support structure for integrally mounting a cam system and a cam actuator in a valvetrain system can comprise an elongated bar extending in the valvetrain system. A first bracket can extend from the elongated bar for mounting to a cylinder head. A second bracket can be connected to the elongated bar and configured to support the cam actuator. A third bracket can extend from the elongated bar and can be configured to support a portion of the cam system.

A support structure for integrally mounting an actuation system and a lost motion spring retention system in a valvetrain system can comprise an elongated bar extending in the valvetrain system. The elongated bar can optionally define lost motion spring seats. A first bracket can extend from the elongated bar for mounting to a cylinder head. A second bracket can be connected to the elongated bar. A third bracket can extend from the elongated bar and can be configured to support a portion of the actuation system. The actuation system can be mounted parallel to a rocker shaft of the valvetrain system.

A valve actuating assembly can comprise a rocker shaft, a first rocker arm pivotably mounted around the rocker shaft, and a second rocker arm pivotably mounted around the rocker shaft. A first valve lifting cam can be operably associated with the first rocker arm to impart a first valve lift profile to the first rocker arm. A second valve lifting cam can be operably associated with the second rocker arm to impart a second valve lift profile to the second rocker arm. A castellation device can be disposed in the second rocker arm and can be configured to selectively add the second valve lift profile to the first valve lift profile to actuate a valve. A rocker arm assembly can comprise a subset of the valve actuating assembly as a configuration for installation on a valvetrain system.

Additional objects and advantages will be set forth in part in the description which follows, and in part will be obvious from the description, or may be learned by practice of the disclosure. The objects and advantages will also be realized and attained by means of the elements and combinations particularly pointed out in the appended claims.

It is to be understood that both the foregoing general description and the following detailed description are exemplary and explanatory only and are not restrictive of the claimed invention.

DETAILED DESCRIPTION

Figure 1:
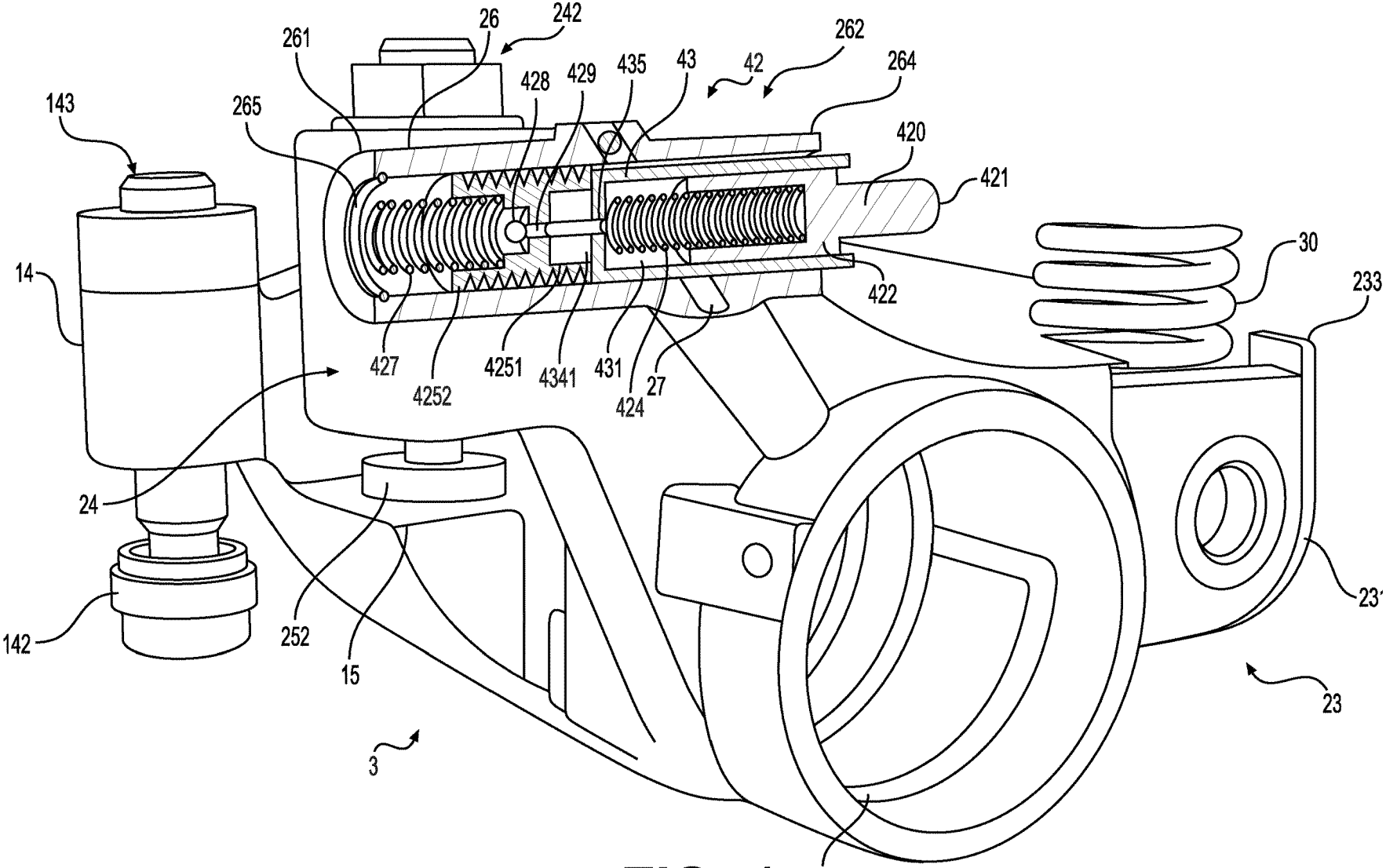
FIG. 1 is a cross-section of a portion of a rocker arm assembly.

Reference will now be made in detail to the examples which are illustrated in the accompanying drawings.

The disclosure comprises valvetrain systems 1, 2, components usable in valvetrain systems, and methods for using the valvetrain systems and components. The valvetrain systems 1, 2 can comprise rocker arms 10, 20 and rocker arm assembly 3, 4, switchable capsules 242, 143 such as lash adjusters and castellation devices, a compliance capsule 41, 42, 44, a support structure 50, 500, an actuation system comprising mechanical sources 310, 360, 370, and combinations thereof. The components of the claimed valvetrain system 1, 2 can constitute components of other valvetrain systems.

Several valvetrain components can be used in rocker arms 10, 20 among other rocker arms and rocker arm assemblies 3, 4. Several rocker arms and valvetrain components can be combined into valvetrain assemblies 1, 2.

A compact added motion valvetrain system in shown in part in FIG. 1. A rocker arm assembly 3 is shown as a dual rocker system comprising a first rocker arm 10 and a second, switchable, rocker arm 20. The dual rocker arm system can be used to extend the duration of the main valve lift. Strategies such as LIVC, EIVC, EEVO, EB, CDA can be implemented.

As one example of a compact added motion valvetrain system 1, 2, FIG. 1 shows portions of a rocker arm assembly 3 usable in valvetrain system 1 or 2. A first rocker arm 10 is assembled next to a second rocker arm 20 for rotation around a rocker shaft 28. An overhead cam rail 60 comprising a camshaft 61 and at least a first lobe 62 and second lobe 63 can be positioned to rotate to convey valve lift profiles to the first and second rocker arms 10, 20 to lift and lower valves 16. Two valves 16 are shown coupled to a bridge 151.

In the example, the first rocker arm 10 comprises body 11 with a rocker shaft bore, also called a rotation bore 12, configured for pivoting or rotating around rocker shaft 28. A lifter end 13 can comprise either a tappet or a roller 132 hung between roller arms 131 for interaction with the overhead cam rail 60. The valve end 14 can comprise a target surface, such as a cantilever 15, machined or molded flat, groove, or projection. A capsule 143 in a capsule bore 26 can be configured for lubrication, switching, or lash adjustment. A mechanical or hydraulic lash adjuster can be configured in the valve end 14. Alternatively, a switchable capsule can be substituted or combined with lash adjustment to provide variable valve lift to the associated valves 16. A castellation device, latched device, plunger, ball and pintle, among others, can comprise a portion of a switchable capsule 143 with actuation comprising one or more hydraulic feed through the body 11, or an external actuator connected to the valve end 14, such as a hydraulic or pneumatic supply line or linkage and solenoid among many other alternatives. Capsule 143 can comprise a spigot or press foot 142.

Second rocker arm 20, in the example, is configured to push on the cantilever 15. But, other configurations and target surfaces can be had, including an arrangement where the second rocker arm 20 presses on a portion of the valve bridge 151, the valve bridge comprising an engine braking modification, among numerous alternatives. A body 21 can comprise a rocker shaft bore 22, a lifter end 23, a roller 232 in roller arms 231, one or more cleat 233 for seating a spring guide 235. Spring guide 235 can comprise a guide plate 236 with a guide post 237. A reaction spring 30 can be included to guide the end of the second rocker arm 20 against the overhead cam rail 60. Reaction spring can also be called a lost motion spring 30.

Figure 3B:
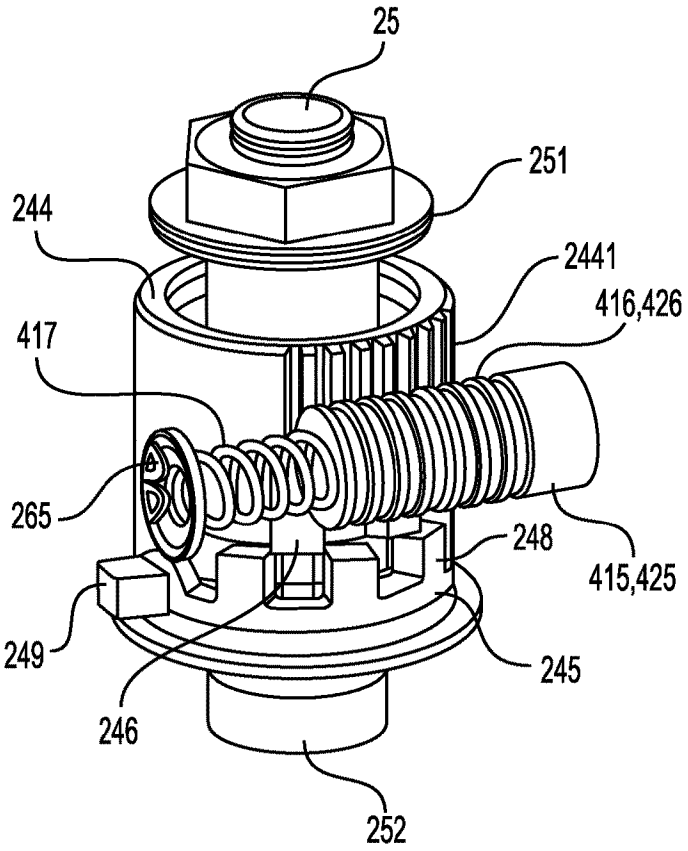
FIGS. 3A & 3B provide an example of a switchable capsule.
Figure 3A:
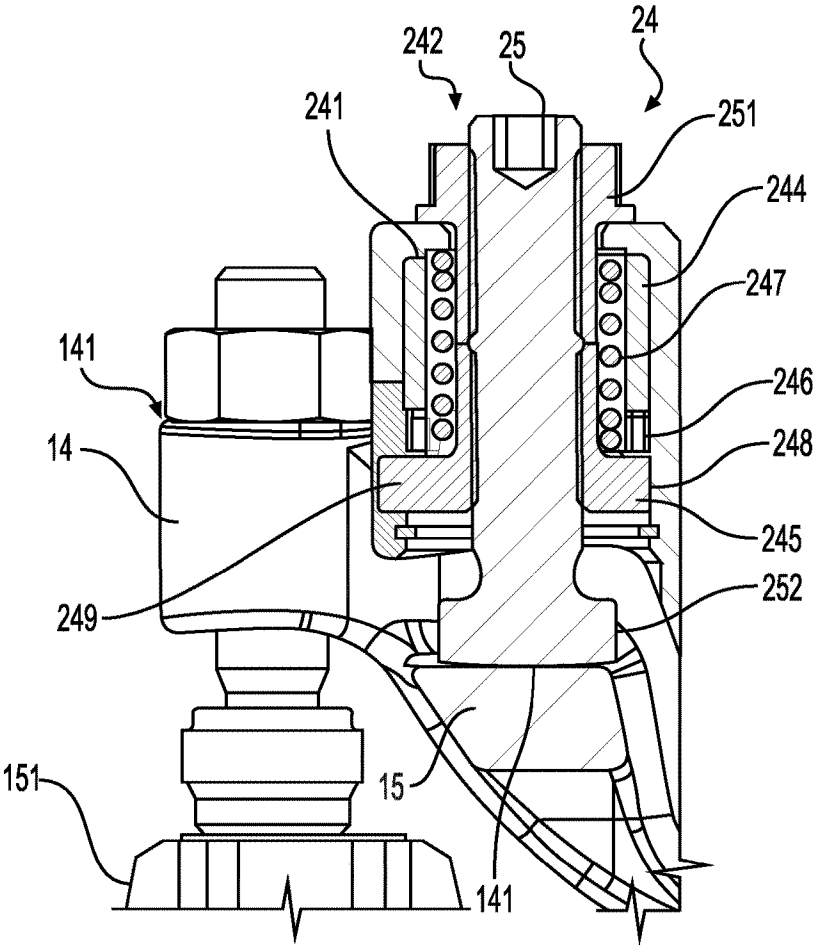
Figure 4:
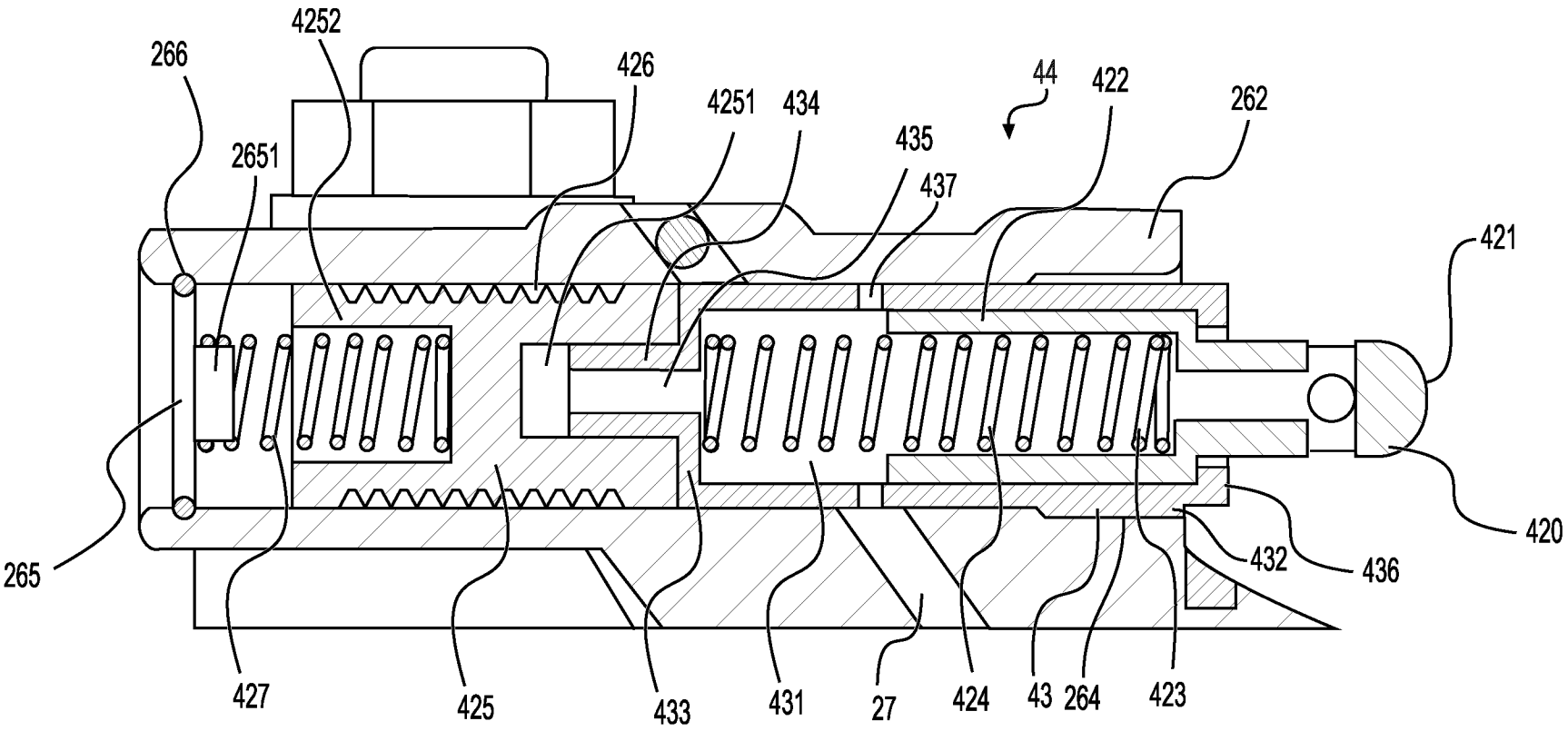
FIG. 4 shows a cross section view of an alternative compliance capsule.
Figure 5A:
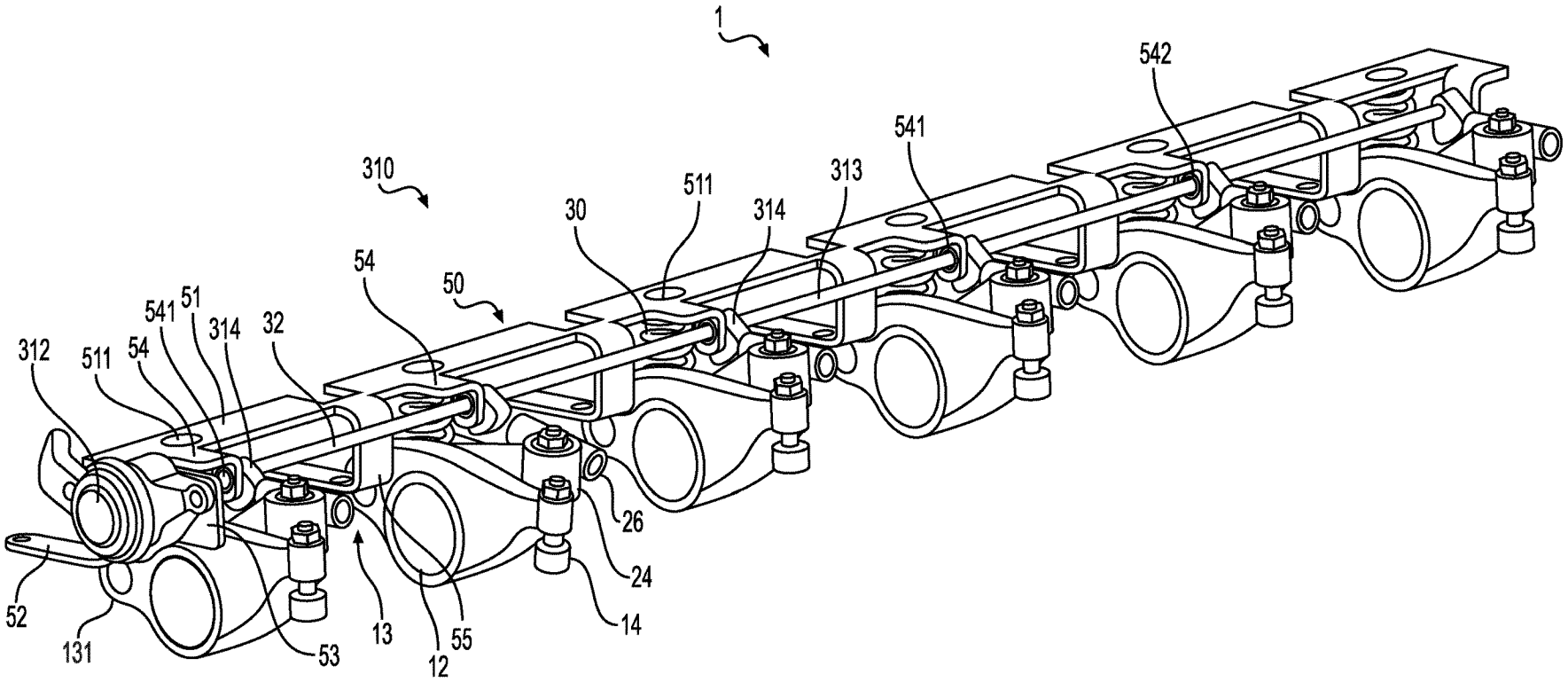
FIGS. 5A-5C show alternative support structures for an actuator of the valvetrain.
Figure 5B:
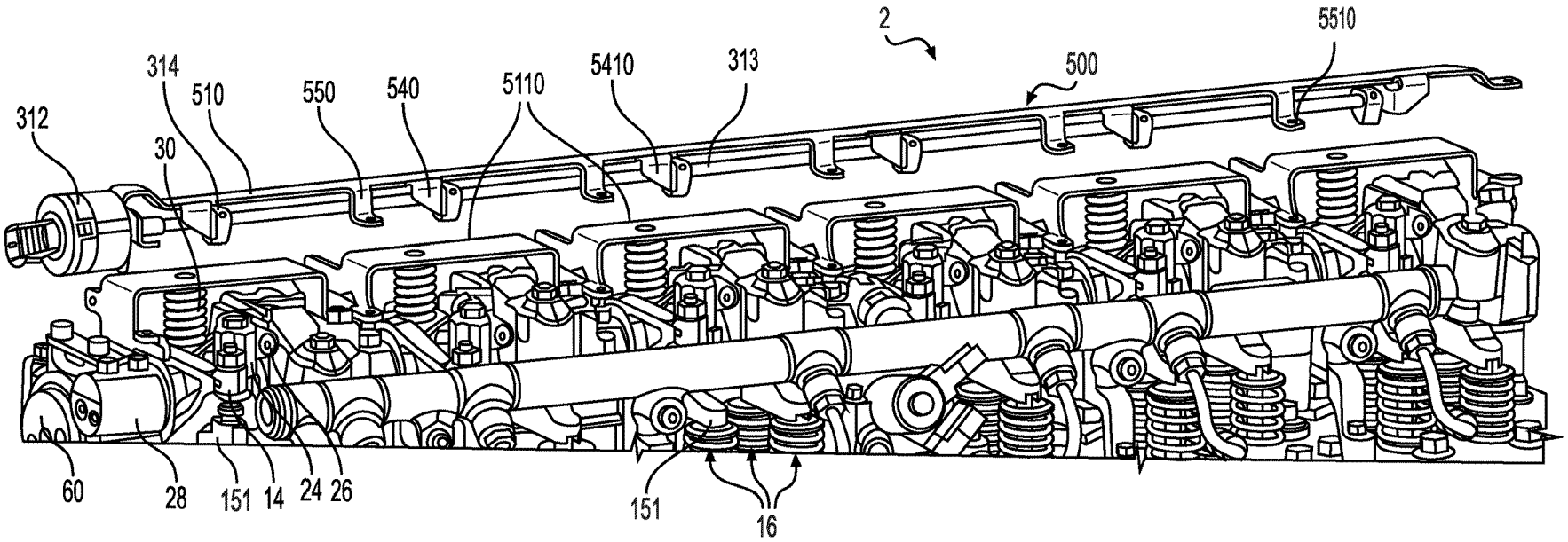
Figure 5C:
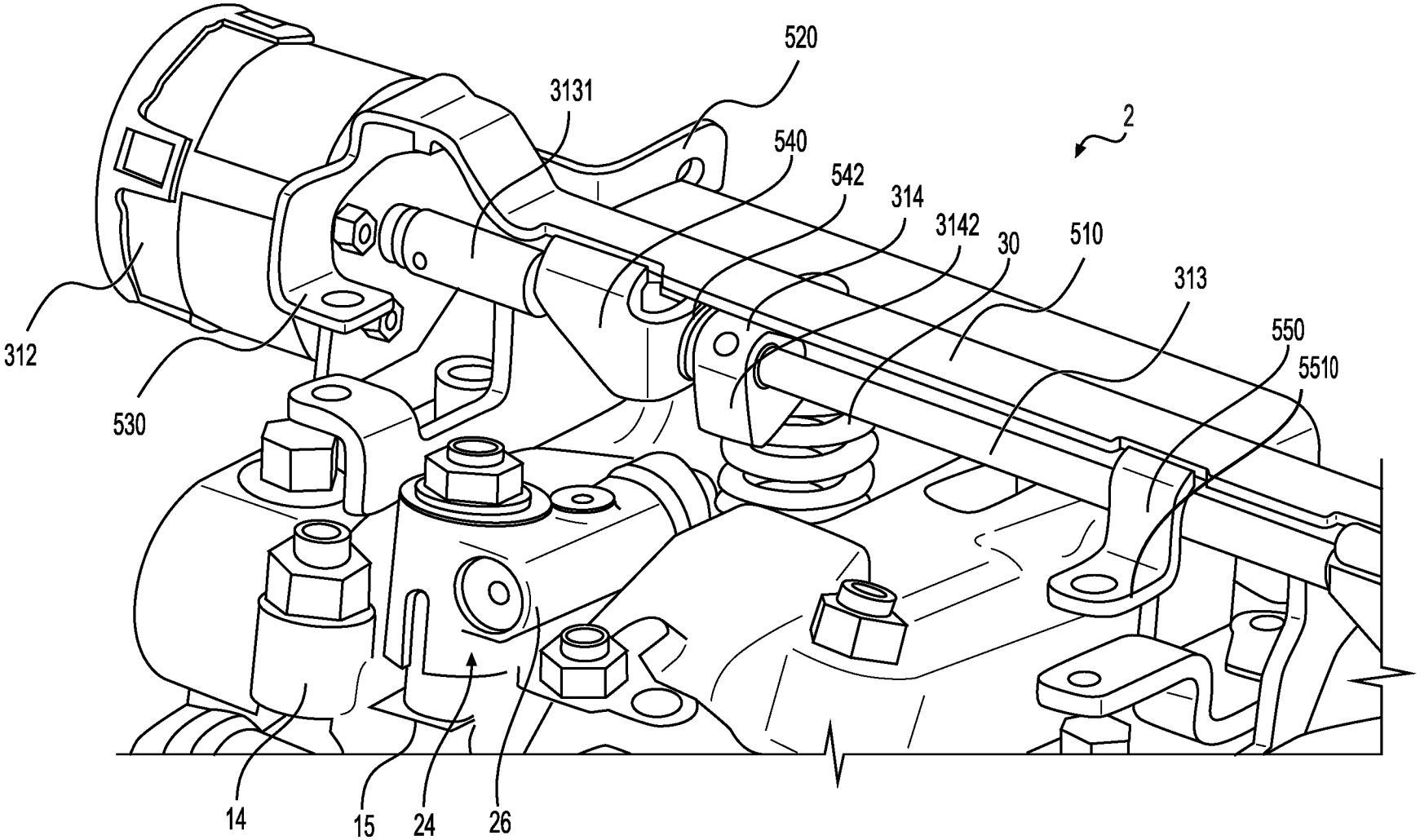
Figure 7:
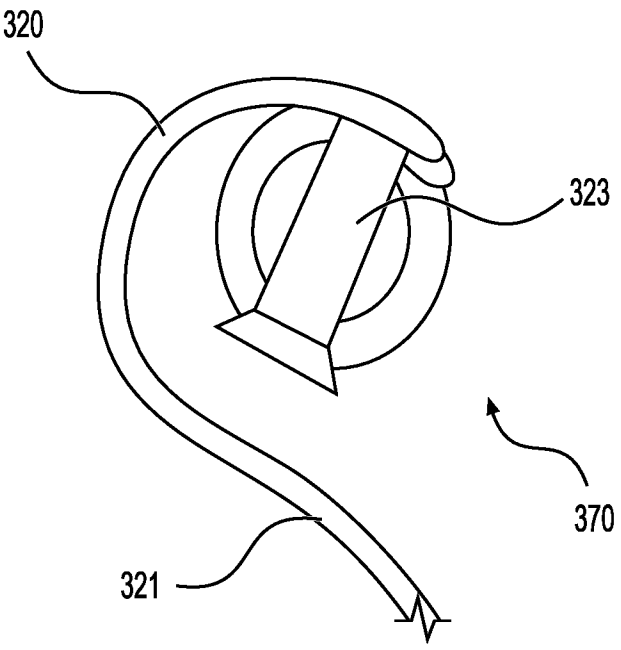
FIGS. 6 & 7 show alternative actuators.
Figure 6:
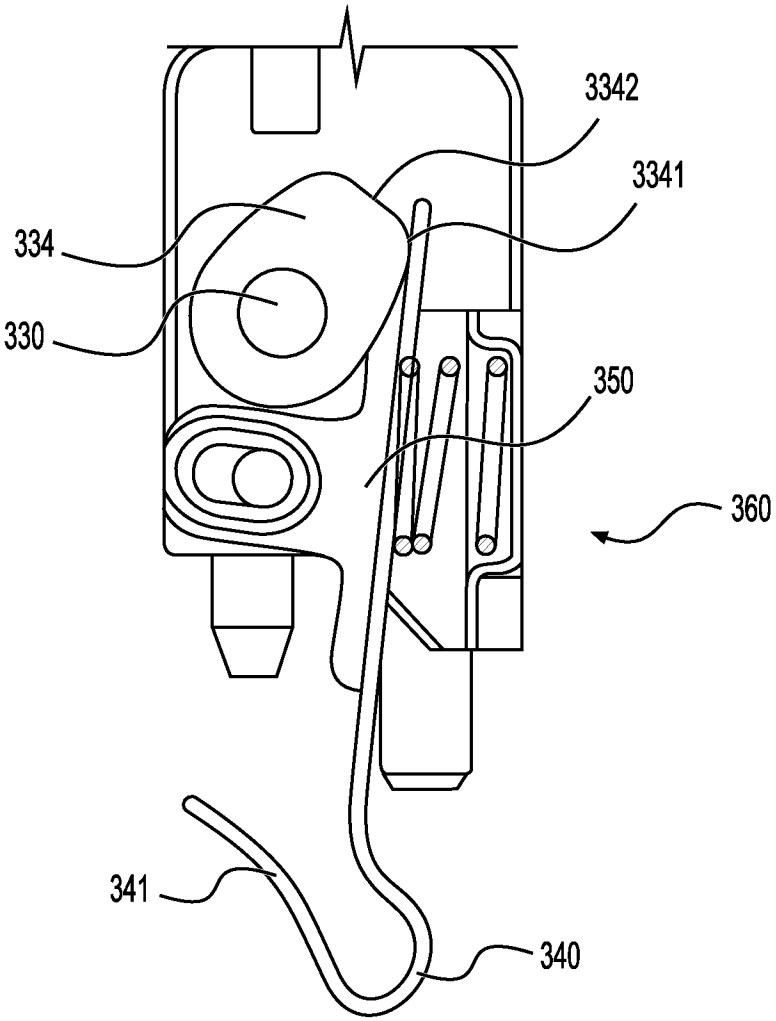

Second rocker arm 20 can comprise a switchable capsule 242 in a capsule bore 241 in the valve end 24. Similar to first rocker arm 10, the second rocker arm 20 can comprise, among the many above-listed alternatives, a lash adjusting capsule, a switchable capsule such as a castellation device or movable piston, and combinations thereof. FIGS. 3A & 3B provide an example of a switchable capsule in the form of a castellation device.

A second bore 26 is shown and can comprise a compliance capsule 41, 42, 44. The rocker arm assembly 3, 4 comprising one rocker arm configured to switchably press against or collapse against another rocker arm is compatible with other actuators such as hydraulic or pneumatic pistons that can be connected to a hydraulic supply in the rocker arm body 21 or to an external actuator and linkage, among many alternatives. However, the compliance capsules 41, 42, 44 herein are electromechanical and can optionally comprise some hydraulic priming aspects.

If a castellation device were used as the switchable capsule 242, a rotatable first castellation piece 244 (also called upper castellation) of the castellation device could be linked to the compliance capsule 41-43 in the bore 26.

Shifting the compliance capsule 41-43 in one direction would rotate the first castellation piece 244 of castellation device to a first position. A biasing spring 247 could push from the capsule bore 241 against a second castellation piece 245. The on-position could engage upper teeth 246 of the first castellation pieces 244 with lower teeth 248 of second (or lower) castellation piece 245, thereby allowing lash assembly to transfer a lift profile to the target surface. A lash screw 25 can comprise a settable lash nut 251 and press-foot 252 such as a spigot or e-foot (elephant foot). An off-position could align the upper and lower teeth 246, 248 to collapse into corresponding cavities between the teeth 246, 248 thereby allowing lash assembly 251 to collapse upward in the capsule bore 241. The press-foot 252 would not transfer force to the cantilever 15 or other target surface. The biasing spring 247 can provide a small force to keep the second rocker arm 20 pressed to the target surface of the first rocker arm 10. Another spring, such as compliance spring 417, 427, mounted in the actuator bore 26 could rotate or bias the first castellation piece 244 to or in the first or second position as a matter of design choice. Regardless of the switchable capsule and actuator combination used, it is beneficial to link the first rocker arm 10 to the second rocker arm 20 for their controlled operation.

Capsule 242 can comprise a switchable capsule disposed in the second rocker arm 20 of the rocker arm assembly 1, 2, 3. The switchable capsule can be configured to selectively switch between the on-position and the off-position. The on-position results in a transfer of force from the second rocker arm 20 to the cantilever 15 or other target surface. The off-position results in the switchable capsule collapsing against the cantilever 15. Numerous examples for switchable capsule 242 and related actuators exist in the art, including but not limited to castellation devices and actuator combinations disclosed in, for example, WO 2019/133658, WO 2019/036272, US2020/0325803, US2018/0187579, U.S. Pat. Nos. 4,227,494, 6,354,265, 6,273,039, & U.S. Pat. No. 4,200,081. These exemplary actuators and castellation devices can be used in the rocker arm assemblies 3, 4, but new actuators in the form of compliance capsules 41-43 are disclosed.

A valvetrain system 1, 2 can be configured with a first rocker arm 10 for conveying a first valve lift to the valves 16 and a second rocker arm 20 for conveying a second valve lift to the valves 16. Any castellation device can be used in a rocker arm as a switchable capsule. When used in a dual rocker arm pairing of FIGS. 1-2C, a first rocker arm 10 can provide a first valve lift profile, then the castellation device can be actuated to either impart or absorb a second valve lift profile from the second rocker arm 20. As one example, the first rocker arm can convey a first intake valve lift profile. Then, the second rocker arm can be switched to the on-position to convey late intake valve closing. The first lift profile can have the second lift profile added to it to result in a combined lift profile.

Whether the first rocker arm 10 or the second rocker arm 20 provides the main lift profile, or whether the added motion, engine braking or cylinder deactivation are provided by the first rocker arm 10 or the second rocker arm 20 is a matter of design choice. Switchable capsules can be included on one or both of the first and second rocker arms 10, 20.

In any case, valvetrain components can be arranged so that a main lift is provided by a first rocker arm, and a second rocker arm, outfitted with a switchable capsule, and alternatively outfitted with a compliance capsule, support system and or additional other valvetrain components disclosed herein, provides an additional valve lift function to the engine valves.

As another example, the engine can be equipped with a (main) first rocker arm 10 for main valve lift, and a second rocker arm 20 for the secondary valve lift. The second rocker arm 20 can incorporate a switchable lost motion mechanism, so that when it is switched in the off-position it will absorb the motion received by the cam, so that no motion will be transferred to the one or more associated valves 16. When the switchable capsule 242 will be turned to the on-position, the cam motion will be transferred from the second rocker arm 20 to the (main) first rocker arm 10. The (main) first rocker arm 10 can have a target surface designed to receive the force from the second rocker arm 20. The target surface can be a lateral cantilever, shelf, projection, ledge, flat, notch or other part on the first rocker arm 10. The switchable capsule 242 can be a mechanical castellation capsule made of at least an upper castellation piece 244, a lower castellation piece 245, a lost motion spring also called a capsule spring 247, and an actuating piston such as lash screw 25. In this example, when the switchable capsule 242 is in the off-position, the upper teeth 246 of the upper castellation piece 244 are aligned to the cavities between lower teeth 248 of the lower castellation piece 245 so as to deliver the lost motion function. To turn on the secondary valve lift, rack 415, 425 can be pushed to move. Rack 415, 425 can be connected to one of the upper or lower castellation pieces 244, 245 so that when it moves, the connected castellation part rotates so that its teeth will align with the teeth of the other castellation part. This blocks the lost motion stroke and thus transfers the cam lift to the main rocker.

The castellation part not connected to the rack 415, 425 can have an anti-rotation feature such as a keyed portion 249 to guarantee a relative rotation between the two castellation parts. Between the two castellation parts there is a lost motion spring, also called capsule spring 247, which can guarantee that the two castellation parts are far enough when unloaded so to allow proper actuation.

It can be said that a valve actuating assembly comprises a rocker shaft 28. A first rocker arm 10 can be pivotably mounted around the rocker shaft 28. A second rocker arm 20 can be pivotably mounted around the rocker shaft. In lieu of direct mounting the two rocker arms 10, 20 to the rocker shaft 28, such rocker arms can be packaged together side-by-side. A first valve lifting cam 62 can be operably associated with the first rocker arm 10 to impart a first valve lift profile to the first rocker arm 10. A second valve lifting cam 63 can be operably associated with the second rocker arm 20 to impart a second valve lift profile to the second rocker arm 20. First valve lifting cam 62 can comprise a base circle 621 (no lift) portion and a first lift profile 622. Second valve lifting cam 63 can comprise a base circle 631 (no lift) portion and a second lift profile 632. Additional and alternative lobe profiles can be included.

A castellation device as a switchable capsule 242 can be disposed in the second rocker arm 20 and configured to selectively add the second valve lift profile to the first valve lift profile to actuate one or more valve 16. First rocker arm 10 can comprise a target surface (such as cantilever 15) to receive force from the second rocker arm 20 that corresponds to the second valve lift profile. Castellation device is switchable on and off and the castellation device is configured to absorb the second valve lift profile imparted by the second valve lifting cam when the castellation device switched off. The castellation device can comprise the lash adjustment screw 25 and a first castellation member (upper or lower castellation piece 244, 245) mounted on the lash adjustment screw 25. A second castellation member (upper or lower castellation piece 244, 245) can be mounted on the lash adjustment screw 25 and can be rotatable relative to the first castellation member between an on-position, at which the castellation device is switched on, and an off-position, at which the castellation device is switched off. When the second castellation member is in the on-position, motion exerted by the second valve lifting cam is transferred to the first rocker arm 10 to add the second valve lift profile to the first valve lift profile. But, when the second castellation member is in the off-position, the motion exerted by the valve lifting cam is absorbed in the castellation device and no second valve lift profile is transferred to the first rocker arm 10. It is also possible that, when the second castellation member (upper or lower castellation piece 244, 245, as designed to be rotatable) is in the on-position, second teeth in the second castellation member align with first teeth in the first castellation member to transfer motion exerted by the second valve lifting cam to the first rocker arm 10 to add the second valve lift profile. When the second castellation member is in the off-position, the second teeth in the second castellation member align with first cavities in the first castellation member so that the castellation device absorbs the motion exerted by the second valve lifting cam, so that no second valve lift profile is transferred to the first rocker arm. The castellation device can comprise capsule spring 247 as a bias spring configured to bias the first castellation member and the second castellation member apart from each other.

As discussed more below, the compliance capsules 41-43 can be configured to rotate the second castellation member between the on-position and the off-position. The compliance capsule 41-43 can comprise a rack 415, 425 constituting a rack gear extendable in a direction substantially perpendicular to the rotating axis of the second castellation member. An exterior surface of the second castellation member can comprise actuation ribs or teeth 2441 for constituting a pinion gear. An additional actuator in the form of a mechanical source 310, 360, 370 can be included to act on the compliance capsule 41-43. The additional actuator can comprise the cam system 32.

With this arrangement, the valve or valves 16 can comprises an intake valve in a combustion engine, with or without a bridge 151. The intake valve can be configured so that the first valve lift profile or the second valve lift profile imparts a late intake valve closing (LIVC) strategy. Or, the intake valve can be configured so that the first valve lift profile or the second valve lift profile imparts one of an early intake valve closing (EIVC) strategy or a cylinder deactivation (CDA) strategy.

It is also possible that the valve or valves comprise an exhaust valve in a combustion engine. The exhaust valve can be configured so that the first valve lift profile or the second valve lift profile imparts a late exhaust valve opening (LEVO) strategy. The exhaust valve can alternatively be configured so that the first valve lift profile or the second valve lift profile imparts one of an early exhaust valve opening (EEVO) strategy, a cylinder deactivation (CDA) strategy, or an engine braking (EB) strategy.

As noted above, an exemplary actuator for the capsule 242 can comprise a compliance capsule 41-43 in the second rocker arm 20. The compliance capsule 41-43 can be configured to selectively switch the switchable capsule 242 between the on-position and the off-position.

The compliance capsule 41-43 allows the transmission of motion from an external actuation source (electromechanical, hydraulic, pneumatic, etc.) to a switchable capsule 242 of the valvetrain system 1, 2. While some aspects are compatible with hydraulics, electromechanical aspects are shown herein in more detail. When the switchable capsule's 242 movement is blocked (e.g. during valve lift when the upper and lower teeth 246, 248 are engaged) the compliance capsule 41-43 absorbs the motion via an elastic element such as one or both of pin spring 413, compliance spring 417, 427, or plunger spring 424. Compliance capsule 41-43 releases the motion so absorbed when the rotation of the switchable capsule 242 is again possible.

The movement of switchable valvetrain components, such as the disclosed castellation devices, can be blocked due to the movement of other components (e.g. camshaft 61 rotation) and might be only activated in certain crankshaft angles. Synchronizing the activation of the external actuation with the crankshaft revolution can be expensive and sometimes impossible. Also, sometimes the external actuation is independent from engine crankshaft rotation. So, to give more flexibility for when the actuation signal is commanded, it is desired to have a first mechanical source 310, 360, 370 that can be switched independent of crankshaft angle or camshaft rotation.

That is, while it is possible to link the disclosed actuation rod 313 to rotate with the crankshaft or camshaft 61, these rotations can be decoupled. Then, instead of a slight discrepancy in the timing of the direct coupling (the gear teeth are not meshed perfectly, a connection is loose, the rate of relative rotations are not perfectly matched, etc.), the decoupled actuation rod 313 can be electronically controlled by an external source 31 commanding a rotary actuator 312. An optional linkage 3131 can connect the actuation rod 313 to the rotary actuator 312. A lobed actuation cam 314 connected to the actuation rod 313 can be positioned to selectively press or release compliance capsule 41-43. If the timing of rotary actuator 312 is not perfect, the mechanical actuation and activity of the compliance capsule can prevent a critical shift. Rotary actuator 312 can be a solenoid motor or other electrically actuated device for switching the position of cam system 32.

Compliance capsules 41-43 comprise alternatives for coupling to switchable capsule 242 while also offering options for interacting with mechanical sources 310, 360, 370.

Actuator bore 26 can be formed to constitute a tubular member, or a separate tubular body such as capsule body 43 can be formed within the tubular body of the actuator bore 26. Actuator bore 26 can comprise a cavity 267, a compliance end 261, & a plunger end 262. Plunger end 262 can optionally include a lip 263 to limit the motion of plunger 410, 420. Or, plunger end 262 can comprise a clamp edge 264 for crimp or press-fitting to a tubular member such as capsule body 43. Compliance capsule 41 can be dropped in through compliance end 261, while compliance capsules 42, 44 can be installed through either or both ends of the actuator bore 26. A retainer 265, such as a snap ring or washer can be seated in a groove 266 or a threaded or pressed plug can be inserted in compliance end 261 to secure the compliance capsule within actuator bore 26.

A spring pin 2651 can be included to guide a compliance spring 417, 427. Pushing against the retainer 265, the compliance spring 417 positions a first body, also called a rack 415, 425. Actuation ribs or teeth 2441 of upper or lower castellation piece 244, 245 can be directly connected to the rack teeth 416, 426 of rack 415, 425 in a rack-and-pinion arrangement. The linear motion of rack 415, 425 results in rotation of the chosen castellation piece. Splines, ribs or other mechanical coupling can be substituted. Compliance spring 417, 427 can push the rack 415, 425, and hence the switchable capsule 242 into a zero position (the on- or off-position, as designed).

Rack 415 can comprise a spring end 4252 with a cup for positioning compliance spring 417. A check 428 such as a ball can be positioned in the spring end 4252 and held in place by compliance spring 427. A port 429 through the body of the rack 425 can lead to a plunger cup 4251. Should the second rocker arm 20 comprise a hydraulic feed 27 from the rocker shaft bore 22, a fluid pressure can be supplied to leak in the compliance capsule 42 or affirmatively fill through leakdown ports 437 in compliance capsule 44. Hydraulic fluid can leak out compliance end 261 or plunger end 262 through ports 429, 435 while providing a pressure pre-set for the compliance capsule 42, 44.

Capsule body 43 can slide in actuator bore 26 and can comprise a peg 434 to be pressed into plunger cup 4251 to move the rack 425 in unison with the plunger 420. Plunger 420, also called second body, comprises a receiving end 421 for receiving actuation force from the mechanical source 310, 360, 370. A guide body 422 can position the plunger 420 within capsule body 43. A spring cup 423 can guide and partially house a plunger spring 424. Capsule body can comprise a cavity 431 and a spring cup 433 against which the plunger spring 424 can be biased. When the mechanical source 310, 360, 370 pushes on the plunger 420, a hydraulic pressure in cavity 431 can be squeezed out ports 429, 435 and through leakdown gaps as controlled orifices, thereby allowing plunger 420 to collapse into capsule body 43 while also moving rack 425. Oil pressure through port 435 pushes on cavity 4341 in plunger cup 4251 and the rack 425 moves hydraulically. Check 428 can release overpressure. However, hydraulic fluid from hydraulic feed 27 also pushes the plunger 420 back against the mechanical source 310, 360, 370. So, the compliant capsule 42 yields to pressure but is resilient to return to its starting position.

Compliant capsule 44 differs from compliant capsule 42 by clamp edges 264 and clamp ends 432 mating to key the capsule body 43 in place. A lip 436 holds the plunger 420 within capsule body 43. A peg 434 includes an extended port 435 to guide hydraulic fluid from hydraulic feed 27 to plunger cup 4251 to push rack 425 to actuate switchable capsule 242. Peg 234 can guide rack 425. Retainer 265 can form a travel limit for rack 425. Many other aspects remain similar to compliant capsule 42 and incorporated from above.

Rack 415 can comprise a pin end 4151 facing plunger 410 (also called second body). Pin spring 414 functions similar to plunger spring 424 to push plunger 410 towards mechanical source 310, 360, 370. But pin spring 414 coils around a spring pin 413 extending from guide body 412. Guide body 422 cannot move past lip 263, and so receiving end 411, also called cam end, is constrained. Actuation pressure from pin spring 414 or spring pin 413 or both can move rack 415 so that rack teeth 416 move linearly and rotate the switchable capsule 242. A spring end 4152 of rack 415 is biased against a compliance spring 417 that can be fixed against a retainer 265.

When load is applied to the first body (rack 415 or 425) and the switchable capsule 242 is free to move, the compliance capsule 41, 42, 44 transmits the motion. If the switchable capsule 242 is blocked, the compliance capsule 41, 42, 44 pre-loads and will move only when the switchable component is free to move. Critical shift is avoided.

Figure 2A:
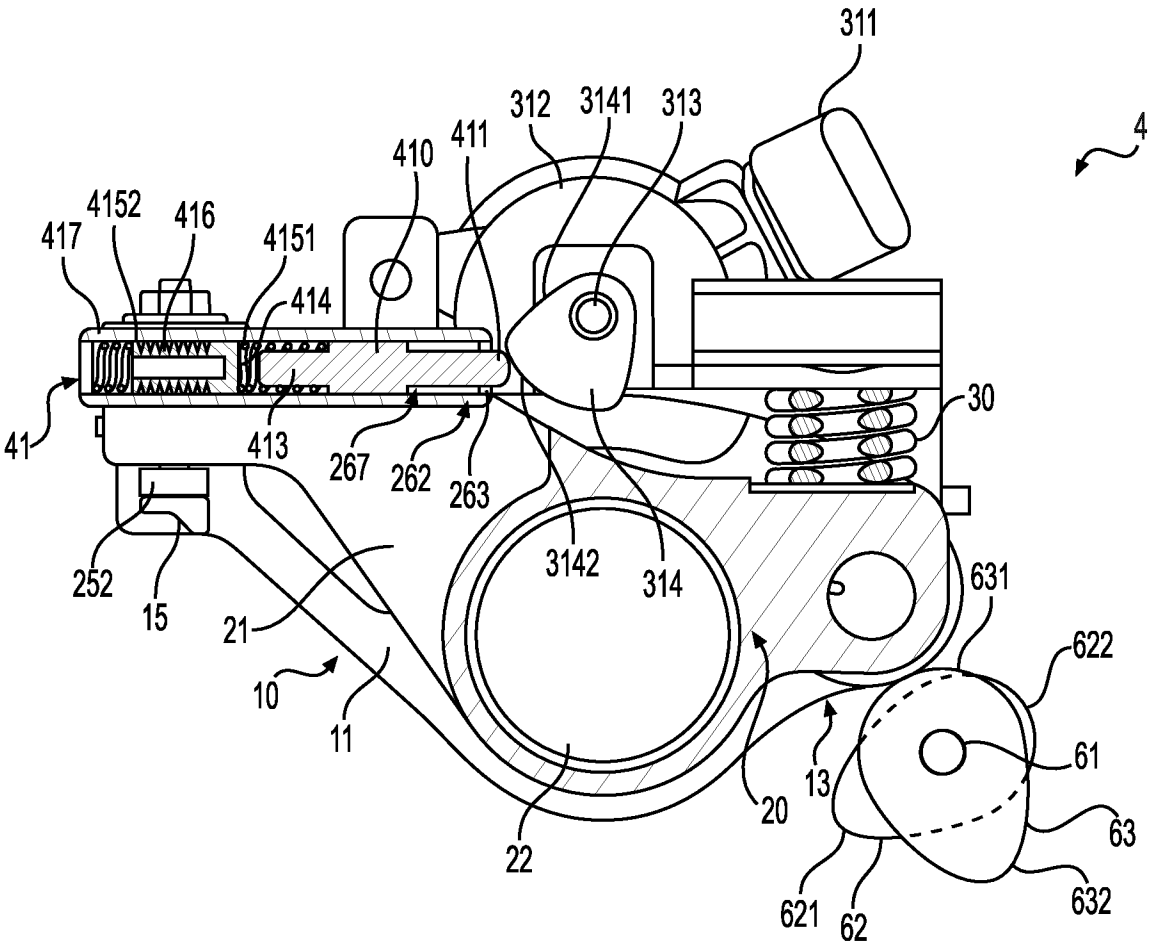
FIGS. 2A-2C show a portion of a valvetrain, including cross-sections of a rocker arm assembly together with a compliance capsule for a switchable capsule of a rocker arm, an actuator, and a support structure for the actuator.
Figure 2B:
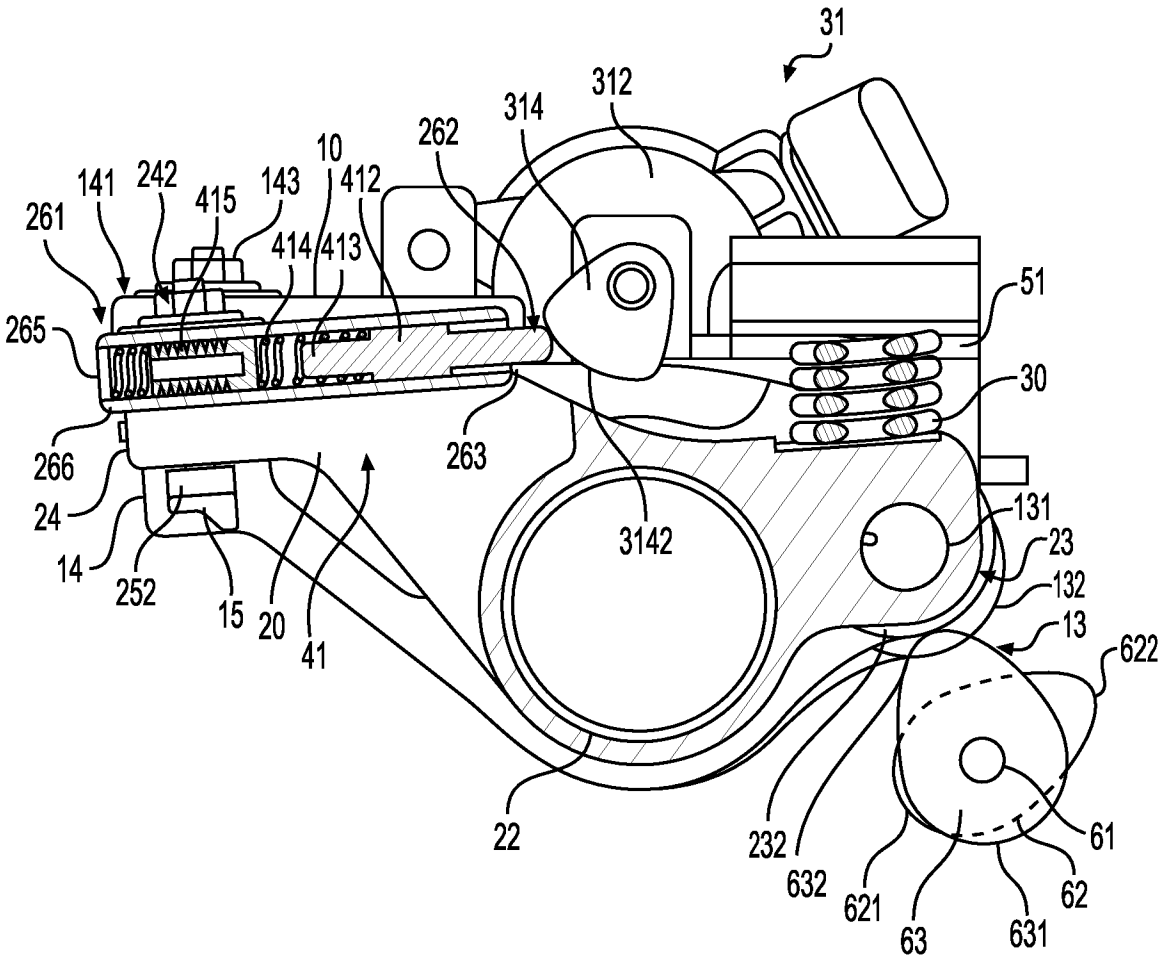
Figure 2C:
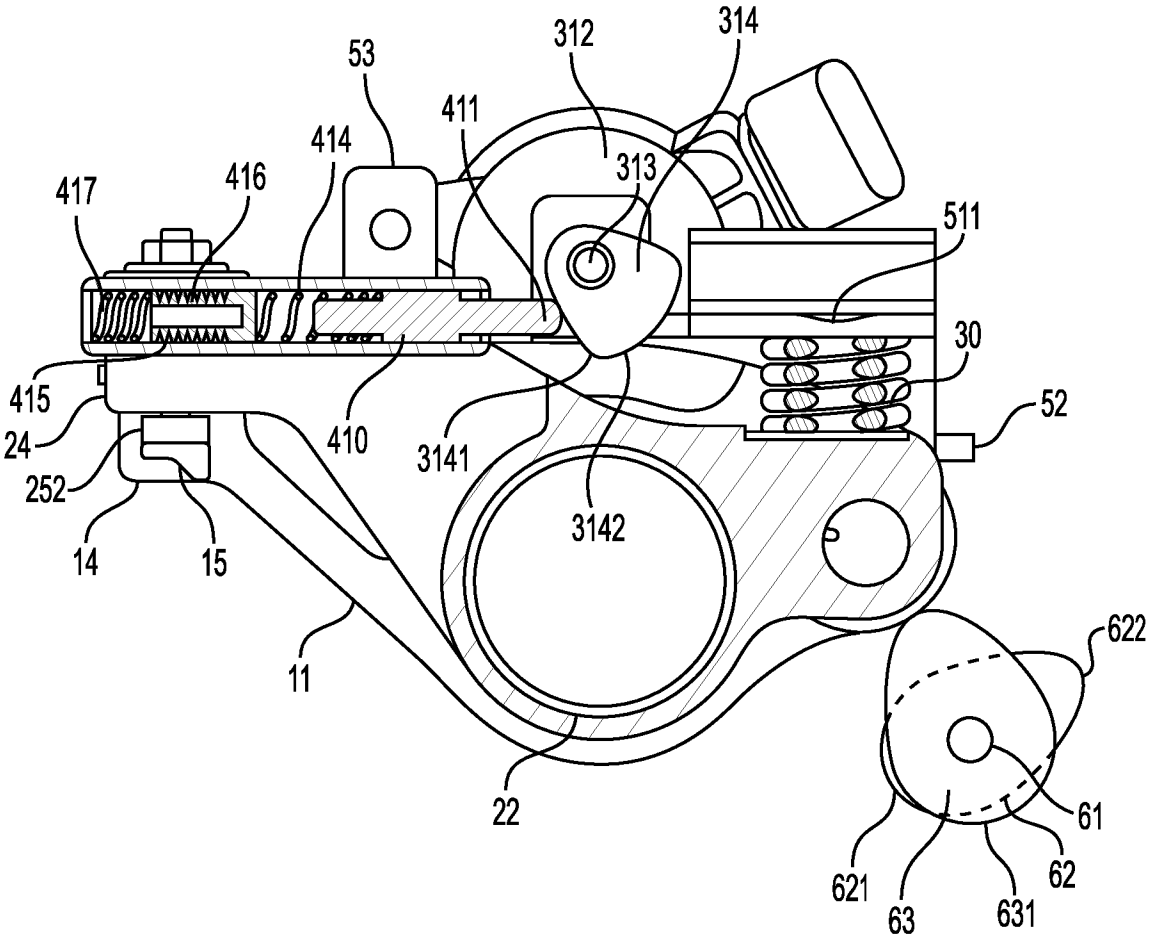

FIG. 2A shows a base circle arrangement where no lift is provided from camshaft 61. However, FIG. 2B shows that the second lift profile 632 is being transferred to the lift end 23 and the valve end 24 is collapsing down against the cantilever 15. This would indicate a lost motion of the second lift profile 632 in the switchable capsule 242. The second lift profile is not transferred to the valve 16. However, FIG. 2C shows the rotary actuator has moved the lobed actuation cam 314 from the lift area 3142 being in contact with the receiving end 411 to the base circle area 3141 being in contact with the receiving end 411. The compliance spring 417 pushes the rack 415 and the switchable capsule 242 is switched. The second lift profile 632 transfers to the target surface so that the first and second rocker arms 10, 20 move according to the second lift profile 632.

If the mechanical source 310, 360, 370 were to move between the base circle and the lift positions while the rocker arm assembly 3, 4 were on full lift, the hydraulic control in compliance capsules 42, 44 would prevent critical shift. Due to the location of the actuation rod 313 and support structure 50, 500, the second rocker arm 20 moves away from the mechanical source, yet the compliant capsules 41, 42, 44 can achieve the transfer of the second lift profile 632 despite the mechanical decoupling. The interaction of the upper and lower castellation teeth 246, 248, whether tooth-on-tooth or tooth-in-cavity, would cause a clenching on lift that would prevent the rack 415, 425 from moving linearly. Smooth decoupling and recoupling of the mechanical features can be achieved despite the rotation of the rocker arms away from the support structure 50, 500.

A compliance capsule 41, 42, 44 for actuating a switchable capsule 242 in a valvetrain system 1, 2 can comprise a tubular member 43, 26 defining a cavity 267. Actuator bore 26 as a tubular member comprises a first end 261 and a second end 262 opposite to the first end. A rack 415, 425 as a first body is slidably disposed in the cavity 267 adjacent the first end 261 and connected to the switchable capsule 242 to selectively transfer a motion to turn the switchable capsule on or off. A plunger 410, 420 as a second body is at least partially and slidably disposed in the cavity 267 adjacent the second end 262. Plunger 410, 420 is configured to receive a force from an external source 31 that can comprise a rotary actuator coupled to a mechanical source 310, 360, 370. A compliance spring 417, 427 can be disposed between the first body (rack 415, 425) and first end 261. Another compliant spring, plunger spring 414, 424, can be disposed against second body (plunger 410, 420). The plunger spring 414 is a compliance spring offering resilient force transfer and actuation force transfer. In one instance plunger spring 414 is between the first body and the second body. In other instances, plunger spring 242 is biased between plunger 420 and additional tubular body (capsule body 43).

External source 31 can comprise a power plug 311 for electrical supply to rotary actuator 312. Rotary actuator 312 can be, for example, an electric motor, solenoid rotor, or other powered device. A linkage 3131 can connect rotary actuator 312 to an actuation rod 313. Alternative mechanical sources 310, 360, 370 are disclosed. External source 31 can comprise the mechanical source configured to move the second body (plunger 410, 420) relative to the tubular member.

Mechanical source 310 comprises a lobed actuation cam 314. Rotating the actuation rod 313 moves the lobed actuation cam 314 between a base circle area 3141 and lift area 3142 being in contact with plunger 410, 420 (second body).

Mechanical source 360 can substitute mechanical source 310. Lobed actuation cam 334 substitutes on actuation rod 30 for lobed actuation cam 314. A base circle area 3341 and lift area 3342 can switchably slide against a lever 350. Mechanical source 360 can switch between pressing a contact arm 341 of spring arm 340 against plunger 410, 420 or withdrawing the pressure from the lobed actuation cam 314 so that only a pretension and not an actuation force remains.

Mechanical source 370 can comprise a substitution that actuation rod 323 be rotated by rotary actuator 312. A spring arm 320 connects to the actuation rod 323 instead of cam lobe. A contact arm 321 extends to selectively press on the plunger 410, 420.

The switchable capsule 242 comprising a castellation device disposed in second rocker arm 20 can be acted on by the first body comprising a toothed rack 415, 425 disposed in the cavity between the first end 261 of the tubular member 26 and the second body 410, 420. The toothed rack is configured to actuate the switchable capsule 242. The first body and the switchable capsule 242 can be configured in a rack and pinion arrangement.

As illustrated, the compliance capsule 41, 42, 44 is used in a rocker arm assembly 3, 4 and valvetrain system 1, 2. However, the compliance capsule can find additional utility in other castellation and switchable capsule arrangements.

To actuate the compliance capsules 41, 42, 44 and provide structure for mechanical sources 310, 360, 370, a support structure 50, 500 can comprise a reaction bar integrated with an electromechanical system and lost motion spring seats. Reaction bar can be directly integrated into an elongate bar 51. Or reaction bars 5110 can be separate structures that can be mechanically coupled to the elongate bar 510. Reaction bar can be used for stabilizing an actuation system of a variable valvetrain component, such as cam actuator 312 and cam system 32.

A support structure 50, 500 can be formed wherein the reaction bar allows the support of the actuation system 32, in these examples, the actuation rod 313, 330 and alternative mechanical sources 310, 360, 370. In addition the support structure 50, 500 allows for the mechanical reaction of a return spring (also called a lost motion or return spring 30) of the second rocker arm 20.

The support structure 505, 500, including reaction bar, could be mounted directly on the cylinder head, on a camshaft support, on a rocker shaft support, or on a cylinder headcover or on any other engine component inside the cylinder head. This is a departure from mounting the support structure on the engine cover.

In heavy duty applications, reinforcing features are needed to take the increased load on the support structure 50, 500. So, the integration of subcomponents and subsequent mounting directly to or inside the cylinder head is not trivial. The integrated components of the support structure 50, 500 allows a feasible mounting of both the actuation system and the actuator of a variable valvetrain component on the cylinder head and allows the mechanical reaction of the return spring of the rocker arm.

A support structure 50, 500 can be made of a single piece or multiple components integrated together. It is possible to integrate a mounting bracket (also called first bracket 52, 520) on the cylinder head, an actuator mounting bracket (also called second bracket 53, 530), and an actuation system mounting bracket (also called third bracket 54, 540). A return spring seat 511 can be stamped or formed as part of elongated bar 510, 510, also. Or, a set of return spring seats 5110 can be installed over the lifter ends 13, 23 of the rocker arm assemblies 3, 4 and the elongated bar 510, 510 can be mounted relative to the set of spring seats 5110.

The support structure can comprise an elongated bar 51, 510 extending in the valvetrain system 1, 2. A first bracket 52, 520 extends from the elongated bar 51, 510 for mounting to a cylinder head. A second bracket 53, 530 can be connected to the elongated bar 51, 510 and configured to support the cam actuator 312. A third bracket 54, 540 can extend from the elongated bar 51, 510 and can be configured to support a portion of the cam system 32. A spring seat 511 can be configured to receive a return spring 30 of a rocker arm. Alternatively, a separate spring seat 5110 on a reaction plate can be set for each rocker arm assembly 3, 4, with the support structure 500 sharing mounting holes on the cylinder head with the separate spring seats. However, the support structure 50 can also be formed so that the elongated bar 51 defines the spring seat 511.

A bridge 55 can connect between the elongated bar 51 and the first bracket 52 to form a unitary piece of material, such as stamped sheet material or pressed or formed sheet material.

A cam shaft 313 can extending from the rotary actuator 312. The third bracket 54 can comprise an opening through which the cam shaft 313 passes through. Opening 541 can comprise a bushing 542, lip, bearing or the like for added structural integrity. Cam system 32 can comprise at least the actuation rod 313 and lobed actuation cam 314.

Instead of a cam system 32 as the mechanical source 310, alternative mechanical sources 360, 370 can be substituted, such as arrangements comprising a spring arm 320 or a lever 350, or a spring actuated lever, or a cam actuated lever. US Publication No. 2019/0063268, issued as U.S. Pat. No. 10,954,826 on 23 Mar. 2021 and incorporated herein by reference, provides examples of such alternative mechanical actuators that can be mounted on the actuation system.

A support structure 50, 500 for integrally mounting a cam system 32 and a cam actuator (rotary actuator 312) in a valvetrain system 1, 2 can comprise an elongated bar 51, 510 extending in the valvetrain system 1, 2. A first bracket 52, 520 can extending from the elongated bar 51, 510 for mounting to a cylinder head. A second bracket 53 530 can be connected to the elongated bar 51, 510 and configured to support the cam actuator 312. A third bracket 54, 540 can extend from the elongated bar 51, 510 and can be configured to support a portion of the cam system 32.

A spring seat 511, 5110 can be configured to receive a return spring 30 of a rocker arm, which can be second rocker arm 20. The elongated bar 51, 510 can define the spring seat 511, 5110, by stamping, crimping, molding, or fastened fixture, among others. Spring seat 511, 5110 can comprise a knob, knurl, insert, post, plate, groove, rim, among others.

First bracket 52, 520 can comprise a plurality of first brackets. The plurality can be distributed along the elongated bar 51, 510, but at least at ends of the elongated bar. Third bracket 54 can comprises a plurality of third brackets. The plurality can be distributed along the elongated bar 51, 510, but at least one third bracket 54, 540 can be included for each second rocker arm 20 in the system that includes a compliance capsule. That is, some cylinders can comprise the added motion of the second rocker arm 20, and some cylinders can have no or different added motion. The number of the first or third brackets 52, 520, 54, 540 can correspond to the number of cylinders in the valvetrain system 1, 2 or to a half-engine number of cylinders, or another number of cylinders.

Third brackets 54, 540 can extend out from elongated bar 51, 510 and can align with respective spring seats 511, 5110. Third brackets 54, 540 can be shaped by bending, stamping, casting or other forming techniques to wrap at least partially over or around actuation rod 313, 330, 323. A portion of the cam system 32 comprising the actuation rod 313, 330, 323 (also called a cam shaft) extending from the cam actuator 312 can be supported by the third brackets 54, 540. Third brackets 54, 540 can comprise an opening 541 through which the cam shaft passes through. The opening 541 can comprise a reinforcing bearing surface 542 such as a bushing, bearing, lip, or the like. While a through hole is shown stamped or punched through each third bracket 54, 540, it can be possible to form a partial circle, a J or hook shape, or snap fit or other supporting shape that the cam shaft can be quickly installed into.

The third bracket 54 has an "L" shaped extension while the third bracket 540 has a "wing" shaped extension. In both instances, a portion of the third bracket 54, 540 is subject to a direction change configured to suspend the actuation rod 313, 330, 323 (cam shaft) from the elongate bar 51, 510. In addition, a portion of the extension can be used to provide a travel limit or alignment feature for the actuation cam 314, 334, lever 350, or spring arm 320.

Elongated bar 51, 510 can extend in a first axis, and the first bracket 52, 520 can extend in a second axis substantially perpendicular to the first axis. The elongated bar 51, 510 can be configured in the first axis so that the actuation system 32, or at least the actuation rod 313, 330, 323 (cam shaft), is mounted parallel to a rocker shaft 28 of the valvetrain system 1, 2. Elongated bar 51, 510 and actuation rod 313, 330, 323 (cam shaft) can also be configured to be mounted above and parallel to an overhead camshaft 61 of the valvetrain system 1, 2.

A bridge 55, 550 can connect between the elongated bar 51, 510 and the cylinder head of the valvetrain system 1, 2. Bridge can be integrally formed with the support structure 50, 500 and can be bent or otherwise shaped to include one or more direction changes to provide a stabilizing area 551, 5510 for fastening to the cylinder head. A through-hole for a stake, rivet, dowel, or screw can be included, or the stabilizing area 551, 5510 can be welded, clipped-in or otherwise secured to the cylinder head. As an alternative, the bridge can be secured to the cylinder head and can be a separate tower structure reaching up to support the elongated bar 51, 510. A cleat, notch, retention slot or other receiving feature can receive the elongated bar to support it. It can be possible to bend or shape the bridge to support the actuation rod 313, 330, 323 (cam shaft). For example, the bridge can abut the actuation rod 313, 330, 323 (cam shaft) to counteract flexing or back pressure from the plungers 410, 420.

At least the elongated bar 51, 510, the first bracket 52, 520, and the third bracket 54, 540 can be integrally formed as a unitary construction.

The cam actuator 312 can be electrically actuated via appropriate use of plug or cable to electrical supply 311. The second bracket 53, 530 can seat an electromechanical interface (electrical supply 311) configured to receive electric signals for electrically actuating the cam actuator 312. Stability of electricity supply and avoidance of loose connections in the high vibration valvetrain system 1, 2 is accomplished by the integrations of the support structure 50, 500.

In lieu of electrical actuation of the cam system 32, cam actuator 312 can be pneumatically or hydraulically actuated to rotate actuation rod 313, 330, 323 (cam shaft). Then, the second bracket 53, 530 seats an interface configured to receive pneumatic or hydraulic signals for actuating the cam actuator 312.

A support structure 50, 500 for integrally mounting an actuation system (cam system) 32 and a lost motion spring retention system 511, 5110 in a valvetrain system 1, 2 can be configured. An elongated bar 51, 510 can extend in the valvetrain system 1, 2. The elongated bar 51 can define lost motion spring seats 511 as a unitary, one piece construction with the elongated bar 51. Or, adjoining spring retainers comprising spring seats 5110 can be physically linked to the elongated bar 510. A first bracket 52, 520 can extend from the elongated bar 51, 510 for mounting to a cylinder head. A second bracket 53, 530 can also be connected to the elongated bar 51, 510. A third bracket 54, 540 can extend from the elongated bar 51, 510 and can be configured to support a portion of the actuation system 32. An electromechanical actuator, such as rotary actuator or cam actuator 312, can be supported on the second bracket 53, 530. The actuation system (cam system) 32 can comprise a cam system, a spring system, a lever system, or a combination spring and lever system as one of the mechanical sources 310, 360, 370.

Other implementations will be apparent to those skilled in the art from consideration of the specification and practice of the examples disclosed herein.

What is claimed is:

1. A compliance capsule for actuating a switchable capsule in a valvetrain system, comprising:

an outer tubular member defining a cavity and comprising a first end and a second end opposite to the first end;

a first body slidably disposed in the cavity adjacent the first end and connected to the switchable capsule to selectively transfer a motion to turn the switchable capsule on or off, wherein the first body comprises an internal cavity;

a second body at least partially and slidably disposed in the cavity adjacent the second end and configured to receive a force from an external source;

a compliance spring disposed between the first body and the second body; and an inner capsule formed as an inner tubular member, the inner capsule comprising:

a first capsule end at least partially disposed inside the internal cavity of the first body; and a second capsule end provided opposite the first capsule end and configured to receive the second body.

2. The compliance capsule of claim 1, wherein the external source comprises a mechanical source configured to move the second body relative to the outer tubular member.

3. The compliance capsule of claim 2, wherein the mechanical source comprises an actuation cam.

4. The compliance capsule of claim 1, wherein the switchable capsule comprises a castellation device disposed in a rocker arm.

5. The compliance capsule of claim 1, wherein the first body comprises a toothed rack disposed in the cavity between the first end of the outer tubular member and the second body, the toothed rack configured to actuate the switchable capsule.

6. The compliance capsule of claim 1, wherein the first body and the switchable capsule are configured in a rack and pinion arrangement.

7. A valve actuating assembly comprising:

a rocker shaft;

a first rocker arm pivotably mounted around the rocker shaft;

a second rocker arm pivotably mounted around the rocker shaft;

a first valve lifting cam operably associated with the first rocker arm to impart a first valve lift profile to the first rocker arm and a second valve lifting cam operably associated with the second rocker arm to impart a second valve lift profile to the second rocker arm; and a castellation device disposed in the second rocker arm and configured to selectively add the second valve lift profile to the first valve lift profile to actuate a valve.

8. The valve actuating assembly of claim 7, wherein the first rocker arm comprises a target surface to receive force from the second rocker arm that corresponds to the second valve lift profile.

9. The valve actuating assembly of claim 8, wherein the valve comprises an intake valve in a combustion engine, and wherein the intake valve is configured so that the first valve lift profile or the second valve lift profile imparts a late intake valve closing (LIVC) strategy.

10. The valve actuating assembly of claim 8, wherein the valve comprises an intake valve in a combustion engine, and wherein the intake valve is configured so that the first valve lift profile or the second valve lift profile imparts one of an early intake valve closing (EIVC) strategy or a cylinder deactivation (CDA) strategy.

11. The valve actuating assembly of claim 8, wherein the valve comprises an exhaust valve in a combustion engine, and wherein the exhaust valve is configured so that the first valve lift profile or the second valve lift profile imparts a late exhaust valve opening (LEVO) strategy.

12. The valve actuating assembly of claim 8, wherein the valve comprises an exhaust valve in a combustion engine, and wherein the exhaust valve is configured so that the first valve lift profile or the second valve lift profile imparts one of an early exhaust valve opening (EEVO) strategy, a cylinder deactivation (CDA) strategy, or an engine braking (EB) strategy.

13. The valve actuating assembly of claim 7, wherein the castellation device is switchable on and off and the castellation device is configured to absorb the second valve lift profile imparted by the second valve lifting cam when the castellation device switched off.

14. The valve actuating assembly of claim 13, wherein the castellation device comprises:

a lash adjustment screw;

a first castellation member mounted on the lash adjustment screw; and a second castellation member mounted on the lash adjustment screw and being rotatable relative to the first castellation member between an on-position, at which the castellation device is switched on, and an off-position, at which the castellation device is switched off, wherein, when the second castellation member is in the on-position, motion exerted by the second valve lifting cam is transferred to the first rocker arm to add the second valve lift profile to the first valve lift profile, and wherein, when the second castellation member is in the off-position, the motion exerted by the second valve lifting cam is absorbed in the castellation device and no second valve lift profile is transferred to the first rocker arm.

15. The valve actuating assembly of claim 14, wherein, when the second castellation member is in the on-position, second teeth in the second castellation member align with first teeth in the first castellation member to transfer motion exerted by the second valve lifting cam to the first rocker arm to add the second valve lift profile, and wherein, when the second castellation member is in the off-position, the second teeth in the second castellation member align with first cavities in the first castellation member so that the castellation device absorbs the motion exerted by the second valve lifting cam, so that no second valve lift profile is transferred to the first rocker arm.

16. The valve actuating assembly of claim 14, wherein the castellation device further comprises a bias spring configured bias the first castellation member and the second castellation member apart from each other.

17. The valve actuating assembly of claim 14, further comprising the compliance capsule of claim 1 configured to rotate the second castellation member between the on-position and the off-position.

18. The valve actuating assembly of claim 17, wherein the compliance capsule comprises a rack gear extendable in a direction substantially perpendicular to the rotating axis of the second castellation member, and wherein an exterior surface of the second castellation member comprises teeth for constituting a pinion gear.

19. The valve actuating assembly of claim 7, wherein the castellation device is configured to selectively add the second valve lift profile to the first valve lift profile by transferring motion exerted by the second valve lifting cam to the first rocker arm.

* * * * *